US009657968B2

(12) United States Patent
Okada

(10) Patent No.: US 9,657,968 B2
(45) Date of Patent: May 23, 2017

(54) COMPRESSOR APPARATUS AND REFRIGERATOR APPARATUS

(71) Applicant: SUMITOMO HEAVY INDUSTRIES, LTD., Tokyo (JP)

(72) Inventor: Makoto Okada, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 237 days.

(21) Appl. No.: 14/180,534

(22) Filed: Feb. 14, 2014

(65) Prior Publication Data

US 2014/0157820 A1 Jun. 12, 2014

Related U.S. Application Data

(63) Continuation of application No. PCT/JP2012/068119, filed on Jul. 17, 2012.

(30) Foreign Application Priority Data

Aug. 26, 2011 (JP) ..... 2011-184991

(51) Int. Cl.

| | |
|---|---|
| ***F25B 39/04*** | (2006.01) |
| ***F25B 1/00*** | (2006.01) |
| ***F25B 9/02*** | (2006.01) |
| *F25B 1/10* | (2006.01) |
| *F28D 1/04* | (2006.01) |

(52) U.S. Cl.

CPC ..... *F25B 1/005* (2013.01); *F25B 9/02* (2013.01); *F25B 1/10* (2013.01); *F28D 1/0443* (2013.01)

(58) Field of Classification Search

CPC .... F25B 1/005; F25B 9/02; F25B 1/10; F28D 1/0443

USPC ..... 62/507, 510, 513

See application file for complete search history.

(56) References Cited

U.S. PATENT DOCUMENTS

| | | | | |
|---|---|---|---|---|
| 4,831,828 | A * | 5/1989 | Klusmier | F04C 29/04 165/185 |
| 5,765,630 | A | 6/1998 | Bloomer | |
| 6,041,608 | A * | 3/2000 | Fujiwara | F25B 9/00 62/229 |
| 2005/0279113 | A1 | 12/2005 | Hoshi et al. | |
| 2010/0300141 | A1 * | 12/2010 | Fujimoto | F25B 1/10 62/498 |

FOREIGN PATENT DOCUMENTS

| | | |
|---|---|---|
| JP | 49-090960 U | 8/1974 |
| JP | 55-003170 U | 1/1980 |

(Continued)

OTHER PUBLICATIONS

International Search Report mailed on Oct. 23. 2012.

*Primary Examiner* — Len Tran
*Assistant Examiner* — Ana Vazquez
(74) *Attorney, Agent, or Firm* — IPUSA, PLLC

(57) ABSTRACT

A compressor apparatus for supplying a compressed refrigerant to a cryogenic refrigerator is disclosed that includes a heat exchanger group that includes a first heat exchanger and a second heat exchanger whose heat exchanging amount is greater than the first heat exchanger; and an axial-flow fan that cools the heat exchanger group. The first heat exchanger is disposed closer to a rotational axis of the axial-flow fan with respect to the second heat exchanger.

4 Claims, 9 Drawing Sheets

(56) References Cited

FOREIGN PATENT DOCUMENTS

| | | | |
|---|---|---|---|
| JP | 55-006733 | U | 1/1980 |
| JP | 60-185875 | U | 12/1985 |
| JP | 03-083775 | U | 8/1991 |
| JP | 2000-314567 | | 11/2000 |
| JP | 2006-002631 | | 1/2006 |

* cited by examiner

COMPRESSOR APPARATUS AND REFRIGERATOR APPARATUS

CROSS-REFERENCE TO RELATED APPLICATIONS

This is a continuation of International Application No. PCT/JP2012/068119, filed on Jul. 17, 2012, which is based upon and claims the benefit of priority of the prior Japanese Patent Application No. 2011-184991, filed on Aug. 26, 2011, the entire contents of which are hereby incorporated by reference.

FIELD

This disclosure is related to a compressor apparatus, which compresses a low pressure refrigerant to supply a high pressure refrigerant to a cryogenic refrigerator. The disclosure is also related to a refrigerator apparatus that includes the compressor apparatus and the cryogenic refrigerator.

BACKGROUND

A refrigerator apparatus that includes a compressor apparatus for compressing a refrigerant such as a helium and a cryogenic refrigerator is known. According to the refrigerator apparatus, a gas heat exchanger is used and a plurality of cooling fans are provided such that a fan with a lower cooling capability is allocated to a heat exchanger pipe for a high pressure helium gas and a fan with a higher cooling capability is allocated to a heat exchanger pipe for a refrigerator oil, thereby increasing cooling efficiency.

However, according to such a compressor apparatus, because there are a plurality of cooling fans, mechanical and electrical losses are increased such that more electric power is required for cooling with, respect to a configuration in which a single fan is used. In particular, with respect to a configuration in which a single large fan is provided in a space for the fans, a total volume of air is reduced, which reduces cooling efficiency.

Further, a pressure loss characteristic curve under a condition of a static pressure becomes greater in the case of using the fans instead of a single large fan, which reduces the volume of air and thus the cooling efficiency. Further, in the case of using the fans, a number of parts is increased, and a cost is increased due to an increase in a failure rate as well as running cost.

SUMMARY

According to one aspect of the embodiments, a compressor apparatus for supplying a compressed refrigerant to a cryogenic refrigerator is disclosed which includes:

a heat exchanger group that includes a first heat exchanger and a second heat exchanger whose heat exchanging amount is greater than the first heat exchanger; and an axial-flow fan that cools the heat exchanger group, wherein the first heat exchanger is disposed closer to a rotational axis of the axial-flow fan with respect to the second heat exchanger.

DESCRIPTION OF EMBODIMENTS

In the following, embodiments will be described with reference to the accompanying drawings.

First Embodiment

Figure 1:
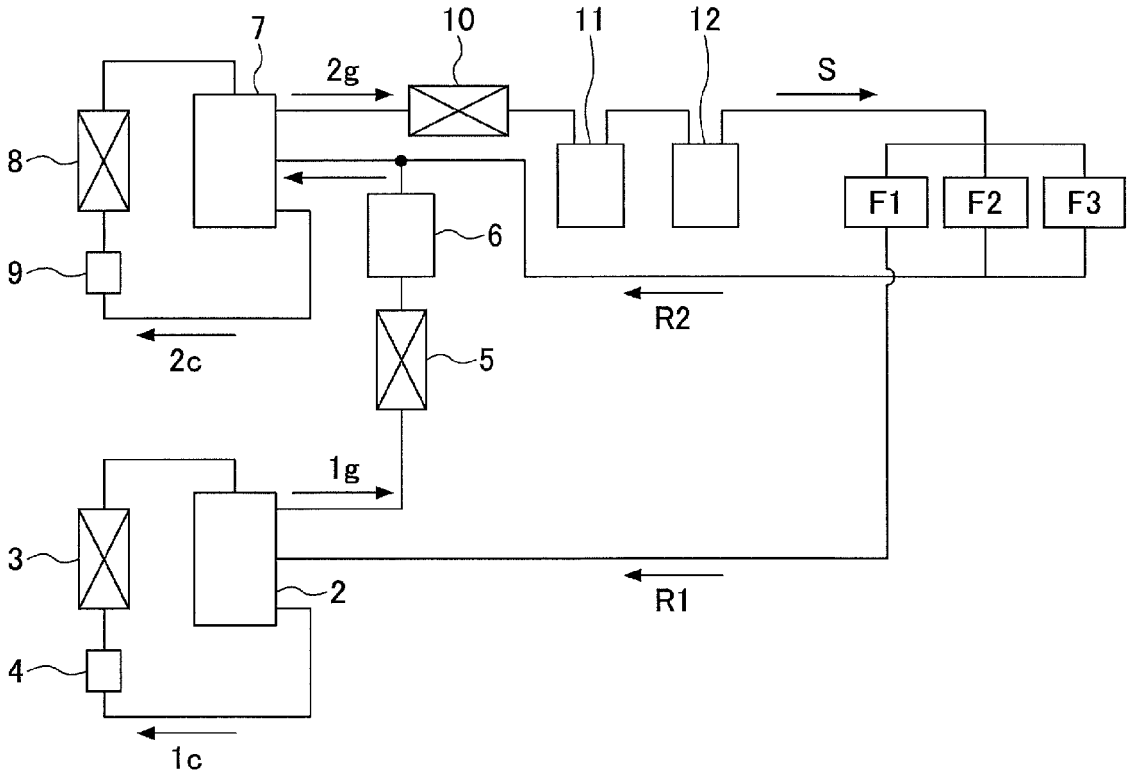
FIG. 1 is a diagram for schematically illustrating a flow of a refrigerant in a compressor apparatus 1 according to a first embodiment.

A compressor apparatus 1 according to a first embodiment includes a compressor 2, an oil cooler 3, an orifice 4, a gas cooler 5, an oil separator 6, a compressor 7, an oil cooler 8, an orifice 9, a gas cooler 10, an oil separator 11, an adsorber 12, pipes for connecting these, if necessary, and a valve unit including a solenoid valve and a check valve necessary for an operation, as illustrated in FIG. 1. A way of connecting these elements are known and thus is not explained in detail.

The compressor apparatus 1 according to the first embodiment includes the compressor 2 on a lower stage side and the compressor 7 on a higher stage side such that the compression is performed in two stages. A cryogenic refrigerator includes a J-T refrigerator F1, a pre-cooling refrigerator F2 and a shield refrigerator F3 that are connected in parallel to a refrigerant gas supply line S illustrated at a right and upper side in FIG. 1 for supplying a high pressure refrigerant gas output from the compressor 7 on a higher stage side. It is noted that, in embodiments described hereinafter including the first embodiment, a term "refrigerator apparatus" indicates a system as a whole that includes a compressor apparatus and a cryogenic refrigerator.

It is noted that, in FIG. 1, a reference number "1*c*" indicates a direction of a flow of an oil on the lower stage side, and a reference number "1*g*" indicates a direction of a flow of a refrigerant gas ejected from the compressor 2 on the lower stage side. Similarly, in FIG. 1, a reference number "2*c*" indicates a direction of a flow of an oil on the higher stage side, and a reference number "2*g*" indicates a direction of a flow of a refrigerant gas ejected from, the compressor 7 on the higher stage side.

In the J-T refrigerator F1, the high pressure refrigerant gas is subject to Joule-Thomson expansion with a J-T valve (not illustrated) to generate a cold of a cryogenic temperature at a cryogenic temperature cooling portion inside a thermal shield plate thereof so that a target to be cooled can be cooled. The J-T refrigerator F1 returns the low pressure refrigerant gas to an inlet side of the compressor 2 via a gas return line R1 illustrated at a right and lower side in FIG. 1.

The pre-cooling refrigerator F2 is of a GM (Gifford-MacMahon) type that expands an expansion space based on a reciprocating motion of a displacer thereof (not illustrated) to pre-cool the high pressure refrigerant gas before the Joule-Thomson expansion at the J-T refrigerator F1. The pre-cooling refrigerator F2 returns the expanded middle pressure refrigerant gas to an inlet side of the compressor 7 via a gas return line R2 illustrated at a right and middle side in FIG. 1.

The shield refrigerator F3 expands an expansion space based on a reciprocating motion of a displacer (not illustrated) that is driven by the high pressure refrigerant gas to cool a thermal shield plate. The expanded gas in the expansion space is returned, as the middle pressure refrigerant gas, to the inlet side of the compressor 7 via the gas return line R2 illustrated in FIG. 1.

The oil cooler 3 includes tubes and fins. The tubes are formed by a material with a high thermal conductivity, such as an aluminum condenser tube. The tubes are disposed side by side in a width direction of the oil cooler 3 such that a heat radiation area becomes as great as possible for cooling the oil of the compressor 2.

The fins are formed of laminated or wave-shaped aluminum plates, for example. The fins are secured to the tube by welding or the like. The fins are formed with distances therebetwen in an extension direction of the tube such that a heat radiation area becomes as great as possible for increasing a cooling effect of the oil.

The oil cooler 8 for cooling the oils of the compressor 7 has substantially the same configuration as the oil cooler 3 described above. The gas cooler 7 and the gas cooler 10 also have substantially the same configuration as the oil cooler 3 described above, and dimensions of their outlines are determined according to heat exchanging amount required to cool the refrigerant gas, if necessary. The orifice 4 is provided for limiting a flow rate of the oil flew into the oil cooler 3, and the orifice 9 is provided for limiting a flow rate of the oil flew into the oil cooler 8.

The oil separator 6 separates the oil included in the refrigerant gas from the gas cooler 5. The oil separator 11 separates the oil included in the refrigerant gas from the gas cooler 10. The adsorber 12 adsorbs the oil left in the separated refrigerant gas.

The oil cooler 3, the gas cooler 5, the oil cooler 8 and the gas cooler 10 are heat exchangers of an air cooling type included in a heat exchanger group of the compressor apparatus 1. The gas cooler 5 and the gas cooler 10 are heat exchangers (gas heat exchangers) used for gas and the oil cooler 3 and the oil cooler 8 are heat exchangers (fluid heat exchangers) used for a fluid. Further, as illustrated in FIG. 1, the compressor 1 according to the first embodiment compresses the refrigerant gas in two stages such that the oil cooler 8 and the gas cooler 10 correspond to the higher stage side exchangers and the oil cooler 3 and the gas cooler 5 correspond to the lower stage side exchangers.

Here, because a specific heat of the oil is higher than that of the refrigerant gas, a heat exchanging amount of the fluid heat exchanger is greater than that of the gas heat exchanger. Further, because a compression ratio of the refrigerant gas at the higher stage side is higher than that at the lower stage side, a heat exchanging amount of the fluid heat exchanger at the higher stage side is greater than that of the gas heat exchanger at the lower stage side. In the compressor apparatus 1 according to the first embodiment, the heat exchanging amount of the oil cooler 8 is higher than that of the gas cooler 10 which in turn is higher than that of the oil cooler 3 which in turn is higher than that of the gas cooler 5.

According to the first embodiment, based on this relationship of the heat exchanging amounts, the oil cooler 8, the gas cooler 10, the oil cooler 3 and the gas cooler 5 included in the heat exchanger group are disposed intensively with respect to a single axial-flow fan 13 for cooling.

Figure 2:
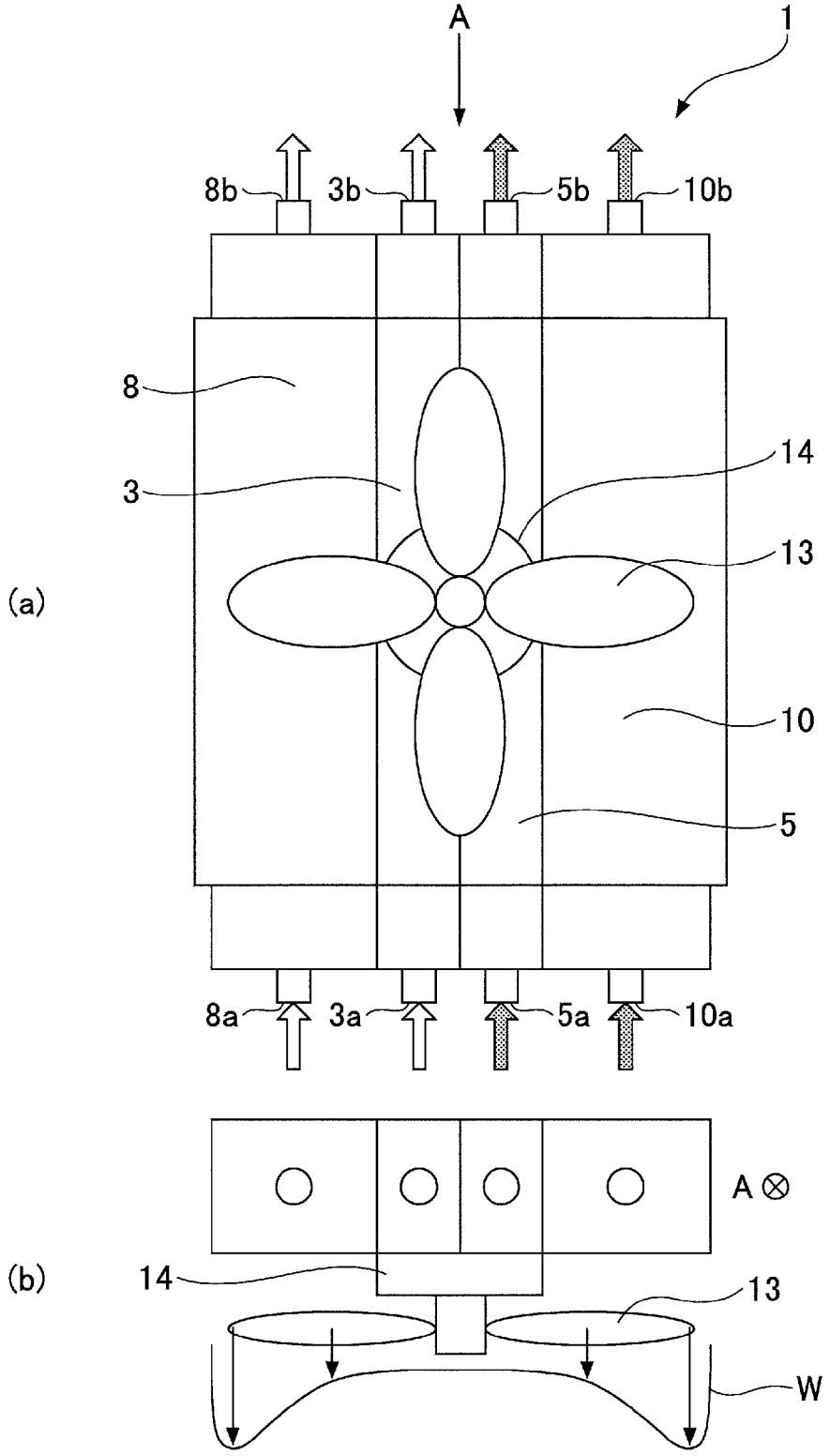
FIG. 2 is a diagram for schematically illustrating the compressor apparatus 1 according to the first embodiment viewed in axial and radial directions of an axial-flow fan 13.

As illustrated in FIG. 2 (*a*), the compressor apparatus 1 according to the first embodiment includes a single large axial-flow fan 13 and a fan motor 14 for driving the axial-flow fan 13 such that first heat exchanger whose heat exchanging amount is smaller than a second heat exchanger is disposed closer to a rotational axis of the axial-flow fan 13 with respect to the second heat exchanger. It is noted that the fan motor 14 is supported by a construction member (not illustrated), if necessary.

Specifically, in FIG. 2 (*a*), with respect to the combination of the oil coolers 8 and 3 on the left side of the rotational axis of the axial-flow fan 13, the oil cooler 3 on the lower stage side, which corresponds to the first heat exchanger, is disposed near the rotational axis of the axial-flow fan 13, and the oil cooler 8 on the higher stage side, which corresponds to the second heat exchanger, is disposed farther from the rotational axis of the axial-flow fan 13. Farther, with respect to the combination of the gas coolers 10 and 5, the gas cooler 5 on the lower stage side, which corresponds to the first heat exchanger, is disposed near the rotational axis of the axial-flow fan 13, and the gas cooler 10 on the higher stage side, which corresponds to the second heat exchanger, is disposed farther from the rotational axis of the axial-flow fan 13.

In FIG. 2 (*a*), the oil cooler 8, the gas cooler 10, the oil cooler 3 and the gas cooler 5 have rectangular parallelepiped shapes that extend in parallel in a direction (in up and down direction in the example illustrated in FIG. 2 (*a*), for example) perpendicular to a radial direction of the rotational axis of the axial-flow fan 13. The respective heat exchangers have widths corresponding to the heat exchanging amounts thereof. The widths are defined with respect to the extension direction of the heat exchangers. The heat exchangers each nave inlets indicated by a numerical subscript "a" and outlets indicated by a numerical subscript "b".

Here, the gas coolers 5 and 10, which are the gas heat exchangers, are concentrated on one side of the rotational axis of the axial-flow fan 13, on the left side in FIG. 2 (*a*), and the oil coolers 8 and 3, which are the fluid heat exchangers, are concentrated on another side of the rotational axis of the axial-flow fan 13, on the left side.

FIG. 2 (*b*) is a view in a direction "A" in FIG. 2 (*a*), and "W" in FIG. 2 (*b*) indicates an air velocity distribution of the axial-flow fan 13. The air velocity distribution W is such that the air velocity at the outer side in the radial direction of the axial-flow fan 13 is higher than that at the inner side. Further, the air velocity distribution W differs depending on a configuration of the axial-flow fan 13; however, in the case of an ordinary axial-flow fan, the air velocity is maximum at a point of a predetermined distance from the outermost portion of the fan. Further, the air velocity decreases linearly in a section from the maximum point to a midpoint in a radial direction, and the air velocity decreases slightly in a section from the midpoint to a central point in a radial direction.

According to the first embodiment, a boundary between the oil coolers 8 and 3 is at the midpoint in a radial direction or near the midpoint in a radial direction. With respect to the gas coolers, as is the case with the oil coolers, a boundary between the gas coolers 10 and 5 is set such that the outer region in a radial direction, in which the air velocity is higher, is allocated, to the heat exchanger whose heat exchanging amount is greater, and the inner region in a radial direction, in which the air velocity is lower, is allocated to the heat exchanger whose heat exchanging amount is smaller.

Figure 3:
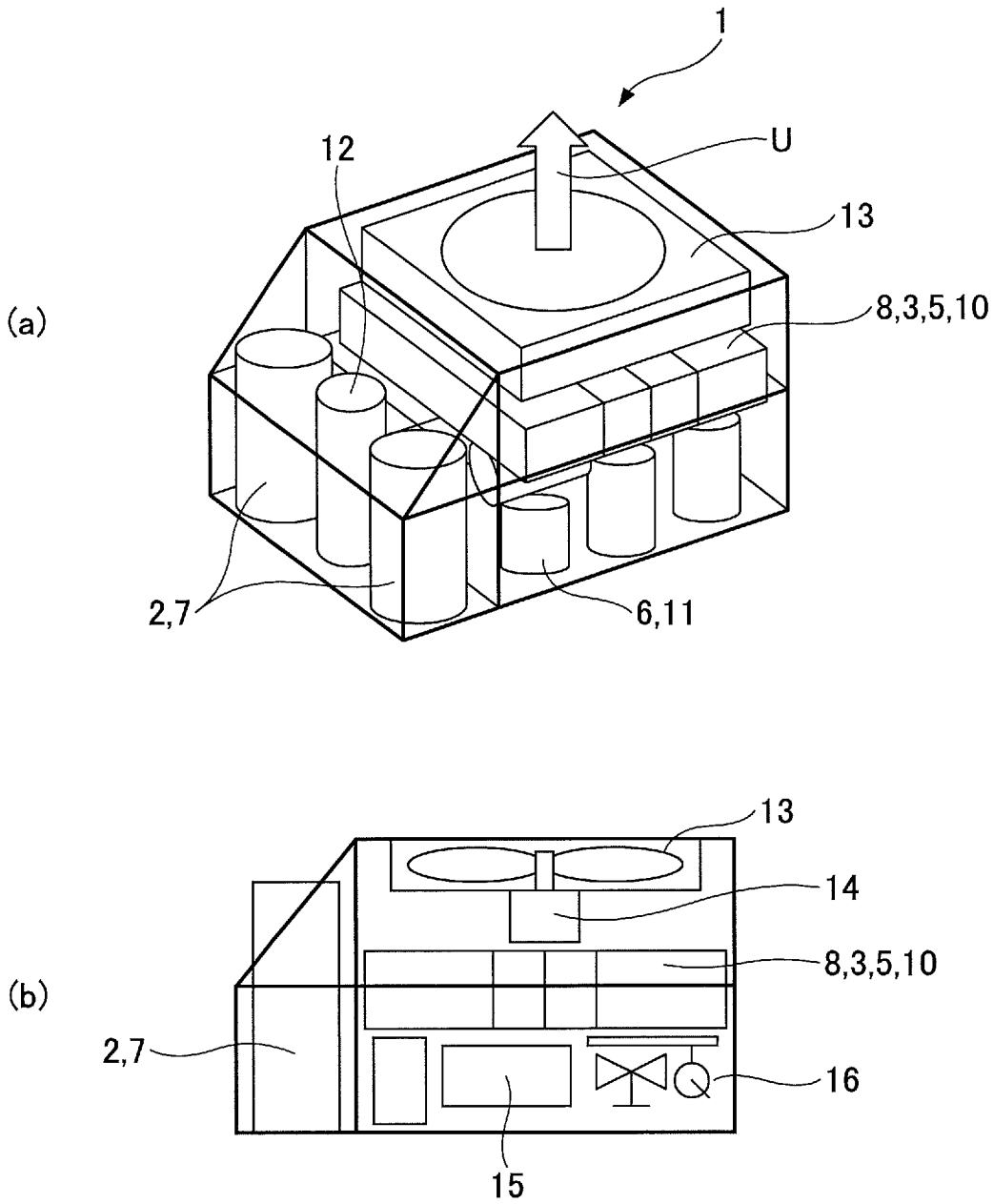
FIG. 3 is a diagram for schematically illustrating a flow of a refrigerant in a compressor apparatus 1 according to a first embodiment.

An appearance of the compressor apparatus 1 according to the first embodiment, and a three-dimensional layout of the components described above including the compressor 1 are such as illustrated in FIG. 3 (*a*) and (*b*). FIG. 3 (*a*) is a perspective view of the compressor apparatus 1 viewed in a direction that is inclined with respect to a discharge direction U and the extension direction. A casing of the compressor apparatus 1 has a pentagonal prism shape that extends in the extension direction of the oil coolers 8 and 3, the gas coolers 10 and 5. The casing includes an upper surface directed to the discharge direction U and a bottom surface that has an area slightly greater than the upper surface.

In FIG. 3 (*a*), the oil cooler 8, the gas cooler 10, the oil cooler 3 and the gas cooler 5 of the heat exchanger group are arranged in this order from left to right such that they are adjacent to the back surface side of the axial-flow fan 13. The compressors 2 and 7 and adsorber 12 are arranged in a region where the bottom surface extends off the upper surface. As illustrated in FIG. 3 (*b*), the oil separator 11, a surge tank 15, which is omitted for illustration in FIG. 1, the valve unit 16, etc., are disposed on the back surface side of the heat exchangers.

As illustrated in FIG. 3 (*b*), in arranging the heat exchangers according to the air velocity distribution W described above, the distances between the axial-flow fan 13, the fan motor 14 and the heat exchanger group 8, 3, 3 and 10 in the rotational axis direction of the axial-flow fan 13 are within such a distance that the characteristic of the air velocity distribution W in the radial direction described above is ensured. In other words, it is preferable that distances between the axial-flow fan 13 and the heat exchanger group 8, 3, 5 and 10 in the rotational axis direction of the axial-flow fan 13 are as small as possible with a constraint in term of a layout in the compressor apparatus 1.

According to the compressor apparatus 1 of the first embodiment, the following advantageous effects can be obtained. According to the prior art described above, a plurality of fans for cooling are provided. In contrast, according to the first embodiment, the single axial-flow fan 13 can cool the heat exchanger group including a plurality of heat exchangers. For this reason, it becomes possible to avoid such a situation where mechanical and electrical losses are increased due to a plurality of cooling fans and thus more electric power is required. Furthermore, it becomes possible to prevent an overall reduction in a volume of air that would be occur in the case of using a plurality of cooling fans, thereby increasing cooling efficiency.

Further, a pressure loss characteristic curve under a condition of a static pressure becomes smaller in the case of using the single large fan 13 instead of the fans, which also increases the cooling efficiency. Further, it becomes possible to reduce a number of parts and cost by reducing a failure rate as well as running cost.

Further, according to the first embodiment, the axial-flow fan 13 is disposed, utilising the air velocity distribution W illustrated in FIG. 2 (*b*) in which the air velocity increases linearly as the position moves outward in a radial direction, such that the beat exchanger with a higher heat exchanging amount, among neighboring heat exchangers, is disposed, outwardly in a radial direction. With this arrangement, it becomes possible to allocate greater volume of air to the heat exchanger with a higher heat exchanging amount while allocating smaller volume of air to the heat exchanger with less heat exchanging amount. As a result of this, more efficient cooling and energy-saving can be implemented.

Further, according to the first, embodiment, the fact that in general an oil cooler has a greater heat exchanging amount than a gas cooler is considered such that the oil coolers 8 and 3 are concentrated on one side of the rotational axis of the axial-flow fan 13 and the gas coolers 10 and 5 are concentrated on the other side of the rotational axis. As a result of this, it becomes possible to avoid thermal interference between the oil coolers 8 and 3 and the gas coolers 10 and 5. In particular, it becomes possible to prevent an increase in the temperature of the gas coolers 10 and 5 due to thermal conduction and radiation of waste heat of the oil coolers 8 and 3.

According to the first embodiment, the fundamental shape of the heat exchanger is a rectangular parallelepiped shape; however, the heat exchanger may have a circular arc cross-section that extends in a circumferential direction of the axial-flow fan 13. This configuration is described hereinafter as a second embodiment.

Second Embodiment

Basic components of a compressor apparatus 21 according to the second embodiment are the same as those in the first embodiment, and thus differences therebetween are mainly described in detail hereinafter. The differences with respect to the first embodiment are that heat exchangers have circular arc cross-sections in a view along the rotational axis of the axial-flow fan 13.

Figure 4:
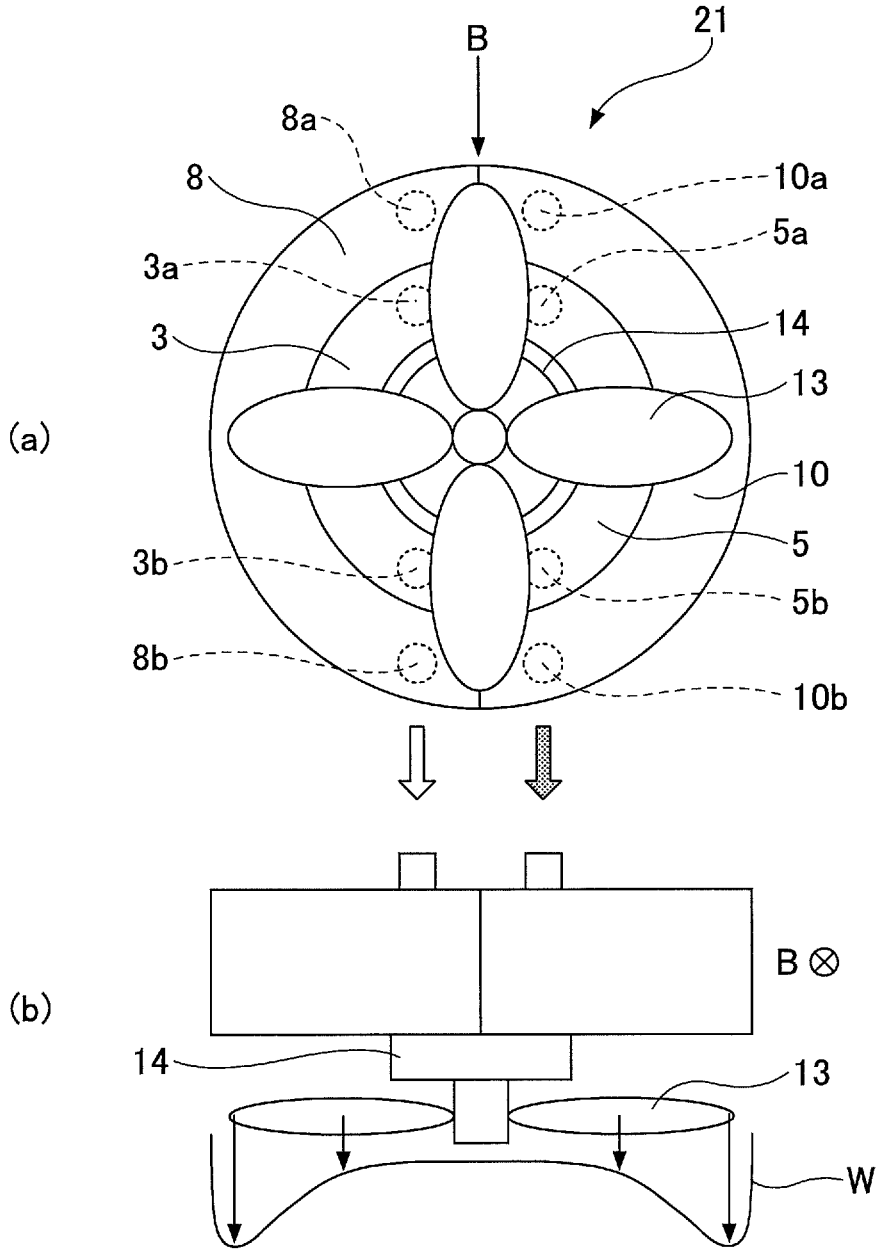
FIG. 4 is a diagram for schematically illustrating the compressor apparatus 21 according to a second embodiment viewed in axial and radial directions of the axial-flow fan 13.

As illustrated in FIG. 4 (*a*), according to the second embodiment, the oil cooler 8, the gas cooler 10, the oil cooler 3 and the gas cooler 5 included in the heat exchanger group have circular arc cross-sections in a view along the rotational axis of the axial-flow fan 13. As is the case with the first embodiment, the oil coolers 8 and 3 are concentrated on left side of the rotational axis of the axial-flow fan 13 and the gas coolers 10 and 5 are concentrated on the right side of the rotational axis.

Similarly, according to the second embodiment, the oil coolers 8 and 3 are disposed such that a boundary between the oil coolers 8 and 3 is at the midpoint in a radial direction or near the midpoint in a radial direction. The gas coolers 10 and 5 are disposed such that a boundary between the gas coolers 10 and 5 is at the midpoint in a radial direction or near the midpoint in a radial direction.

Specifically, according to the second embodiment, as illustrated in FIG. 4 (*b*) which is a view of "B" in FIG. 4 (*a*), the heat exchanger with a higher heat exchanging amount, among neighboring heat exchangers in a radial direction, is allocated an outward region in a radial direction in which the air velocity is higher, while the heat exchanger with less heat exchanging amount is allocated an inward region in a radial direction in which the air velocity is lower. The neat exchangers each have inlets indicated by a numerical subscript "a" and outlets indicated by a numerical subscript "b". Unlike the heat exchangers according to the first embodiment, the heat exchangers according to the second embodiment are projected on the backsides thereof, as indicated by a dotted circle in FIG. 4 (*a*).

According to the compressor apparatus 21 of the second embodiment, the following advantageous effects can be obtained, as is the case with the first embodiment. Specifically, it becomes possible to avoid such a situation according to the prior art where mechanical and electrical losses are increased due to the increased number of the cooling fans and the fan motors and thus more electric power is required. Furthermore, it becomes possible to prevent an overall reduction in a volume of air and increase cooling efficiency. Further, it becomes possible to reduce a number of parts and cost by reducing a failure rate as well as running cost.

Furthermore, according to the second embodiment, the heat exchanger with a higher heat exchanging amount, among neighboring heat exchangers in a radial direction, is disposed to more precisely correspond to the air velocity distribution W of the axial-flow fan 13 in the circumferential direction. The air velocity distribution W is such that the air velocity increases linearly as the position moves outward in a radial direction as illustrated in FIG. 4 (*b*). Thus, it becomes possible to more precisely allocate a higher air velocity region to the heat exchanger with a higher heat exchanging amount and a lower air velocity region to the heat exchanger with a lower heat exchanging amount. As a result of this, more efficient cooling can be implemented, and energy-saving can be enhanced.

Further, also according to the second embodiment, the oil coolers 8 and 3 are concentrated on one side of the rotational axis of the axial-flow fan 13 and the gas coolers 10 and 5 are concentrated on the other side of the rotational axis. As a result of this, it becomes possible to avoid thermal interference between the oil coolers 8 and 3 and the gas coolers 10 and 5.

Further, according to the compressor apparatus 21 of the second embodiment, because the heat exchangers extend, in the circumferential direction of the axial-flow fan 13, the heat exchanging amount, of the heat exchanger at the outward position in a radial direction can be more easily adjusted by adjusting not only the width with respect to the extension direction, but also the length in the extension direction than that of the heat exchanger at the inward position in a radial direction.

Specifically, because the heat exchanger at the outward position in a radial direction can be longer in the extension direction than the heat exchanger at the inward position in a radial direction, the width (dimension in the radial direction) of the heat exchanger at the outward position in a radial direction can be made smaller, in particular. As a result of this, it becomes possible to increase a volumetric efficiency of the heat exchanger group 8, 3, 5 and 10 as a whole, a volumetric efficiency and the mounting efficiency of the compressor apparatus 21 itself.

According to the first and second embodiments, the refrigerator is of a two-stage type; however, the embodiments can be applied to a refrigerator of a single-stage type. This configuration is described hereinafter as a third embodiment.

Third Embodiment

The system configuration of the compressor apparatuses 1 and 21 according to the first and second embodiments is such as illustrated in FIG. 1. In contrast, a compressor apparatus 31 of a single-stage type according to the third embodiment is configured such that it includes a single refrigerator 17 of a GM type as described above, for example. Components themselves are basically not different from those illustrated in FIG. 1. Thus, in FIG. 5, corresponding components are given the same reference numbers and a reluctant explanation is omitted to the extent possible.

Figure 5:
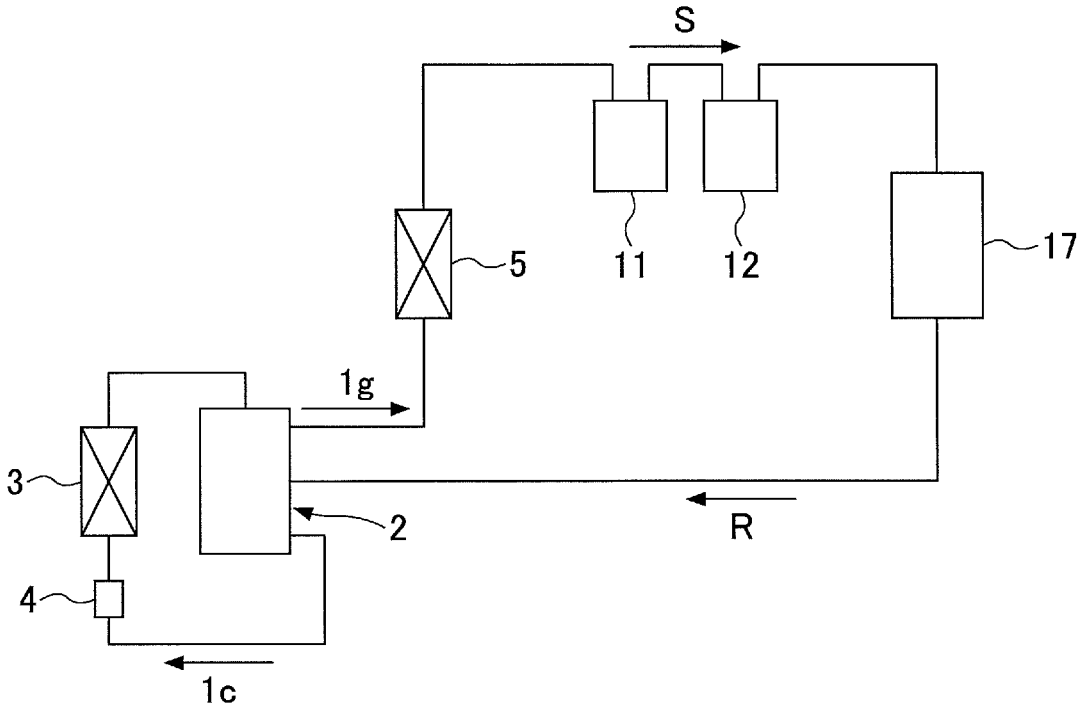
FIG. 5 is a diagram for schematically illustrating a flow of a refrigerant (refrigerant gas) in a compressor apparatus 31 according to a third embodiment.

As illustrated in FIG. 5, the compressor apparatus 31 according to the third embodiment includes a compressor 2, an oil cooler 3, an orifice 4, a gas cooler 5, an oil separator 11, an adsorber 12, pipes for connecting these, if necessary, and a valve unit including a solenoid valve and a check valve necessary for an operation, as illustrated in FIG. 5. It is noted that, because the compressor apparatus 31 is of a single-stage type, the valve unit according to the third embodiment can be simplified with respect to those of the first and second embodiments.

Basic components of a compressor apparatus 31 according to the third embodiment are the same as those in the first and second embodiments, and thus differences are mainly described in detail hereinafter. The differences with respect to the first and second embodiments are that heat exchangers have ring shapes in a view along the rotational axis of the axial-flow fan 13 such that the opposite ends of the ring shape are adjacent and opposed to each other in a circumferential direction.

Figure 6:
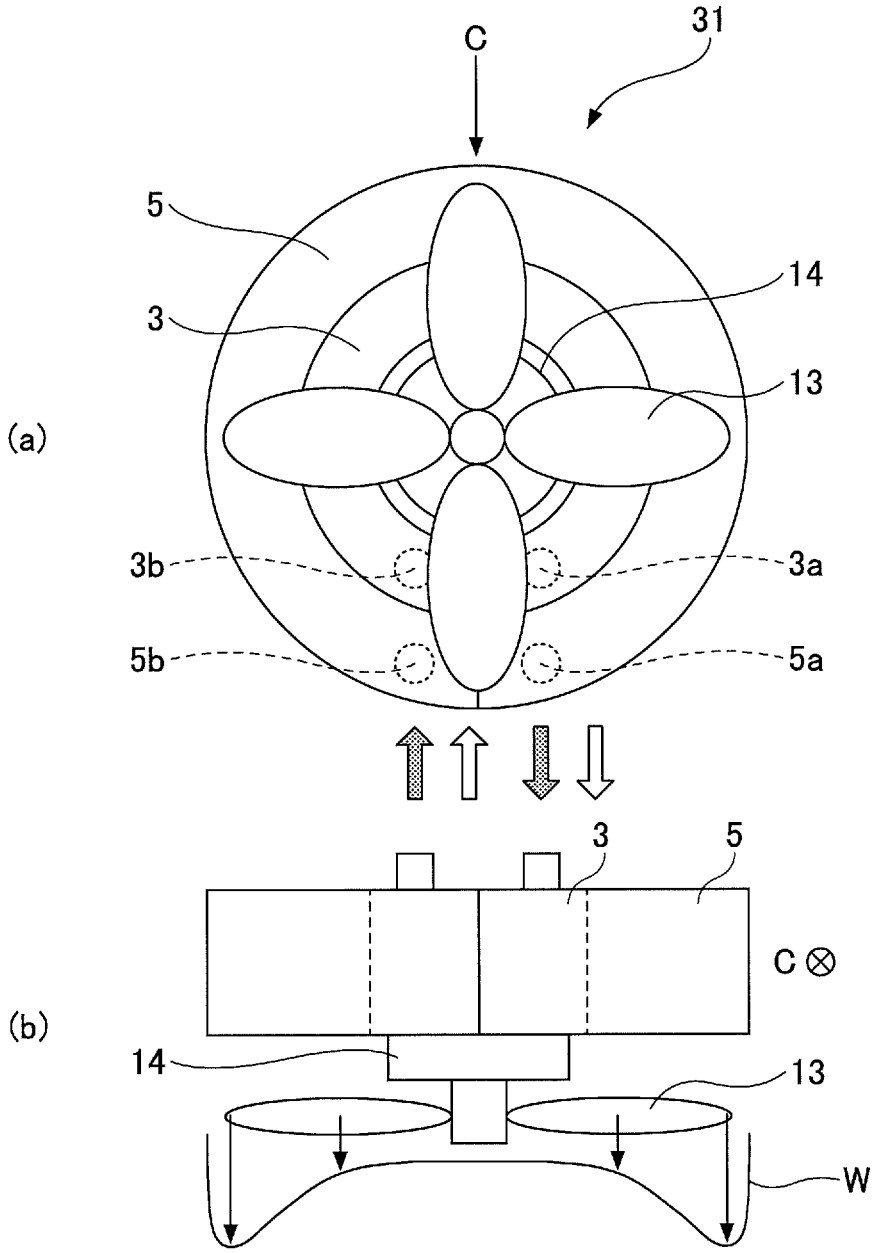
FIG. 6 is a diagram for schematically illustrating the compressor apparatus 31 according to the third embodiment viewed in axial and radial directions of the axial-flow fan 13.

As illustrated in FIG. 6 (*a*), according to the third embodiment, the oil cooler 3 and the gas cooler 5 included in a heat exchanger group have ring shapes in a view along the rotational axis of the axial-flow fan 13. Similarly, in the third embodiment, the oil cooler 3 and the gas cooler 5 are adjacent to each other such that a boundary between the oil cooler 3 and the gas cooler 5 is at the midpoint in a radial direction or near the midpoint in a radial direction described above with reference to the air velocity distribution W, as illustrated in FIG. 6 (*b*) which is a view in a direction "C" in FIG. 6 (*a*).

In the third embodiment, it is assumed that the heat exchanging amount of the gas cooler 5 is greater than that of the oil cooler 3. This is because the flow rate of the helium gas (an example of the refrigerant gas) at the gas cooler 5 is substantially greater than that at the oil cooler 3, for example. For this reason, the gas cooler 5 with a higher heat exchanging amount, among the oil cooler 3 and the gas cooler 5, which are neighboring neat exchangers in a radial direction, is allocated an outward region in a radial direction of the air velocity distribution W in which the air velocity is higher such as illustrated in FIG. 6 (*b*), while the oil cooler 3 with less heat exchanging amount is allocated an inward region in a radial direction in which the air velocity is lower. The oil cooler 3 and the gas cooler 5 each have inlets indicated by a numerical subscript "a" and outlets indicated by a numerical subscript "b". The inlets are adjacent to and opposed to each other and are projected toward the back side. The outlets are adjacent to and opposed to each other and are projected toward the back side.

According to the compressor apparatus 31 of the third embodiment, it becomes possible to avoid such a situation where mechanical and electrical losses are increased due to the increased number of the cooling fans and the fan motors and thus more electric power is required. Furthermore, it becomes possible to prevent an overall reduction in a volume of air and increase cooling efficiency. Further, it becomes possible to reduce a number of parts and cost by reducing a failure rate as well as running cost.

Further, according to the third embodiment, with respect to the air velocity distribution W illustrated in FIG. 6 (*b*) in which the air velocity increases linearly as the position moves outward in a radial direction, the gas cooler 5 with a higher heat exchanging amount is disposed such that it more precisely corresponds to the air velocity distribution W of the axial-flow fan 13 in the circumferential direction. Thus, it becomes possible to more precisely allocate a higher air velocity region to the gas cooler 5 with a higher heat exchanging amount and a lower air velocity region to the oil cooler 3 with a lower heat exchanging amount, thereby increasing cooling efficiency.

According to the third embodiment, as is the case with the second embodiment, the heat exchangers extend in the circumferential, direction of the axial-flow fan 13. Thus, because the heat exchanger at the outward position in a radial direction can be longer in the extension direction than the heat exchanger at the inward position in a radial direction, the width (dimension in the radial direction) of the heat exchanger at the outward position in a radial direction, can be made smaller.

It is noted that the heat exchangers may partially extend in the circumferential direction of the axial-flow fan 13. This configuration, is described hereinafter as a fourth embodiment.

Fourth Embodiment

Basic components of a compressor apparatus 41 according to the fourth embodiment are the same as those in the third embodiment, and thus differences therebetween are mainly described, in detail hereinafter. The fourth embodiment differs from the third embodiment in that the ends of the neat exchangers at the inlets thereof and the outlets thereof are straight-shaped and intermediate portions between the ends at the inlets and the outlets extend in the circumferential direction to form, a U-shape.

Figure 7:
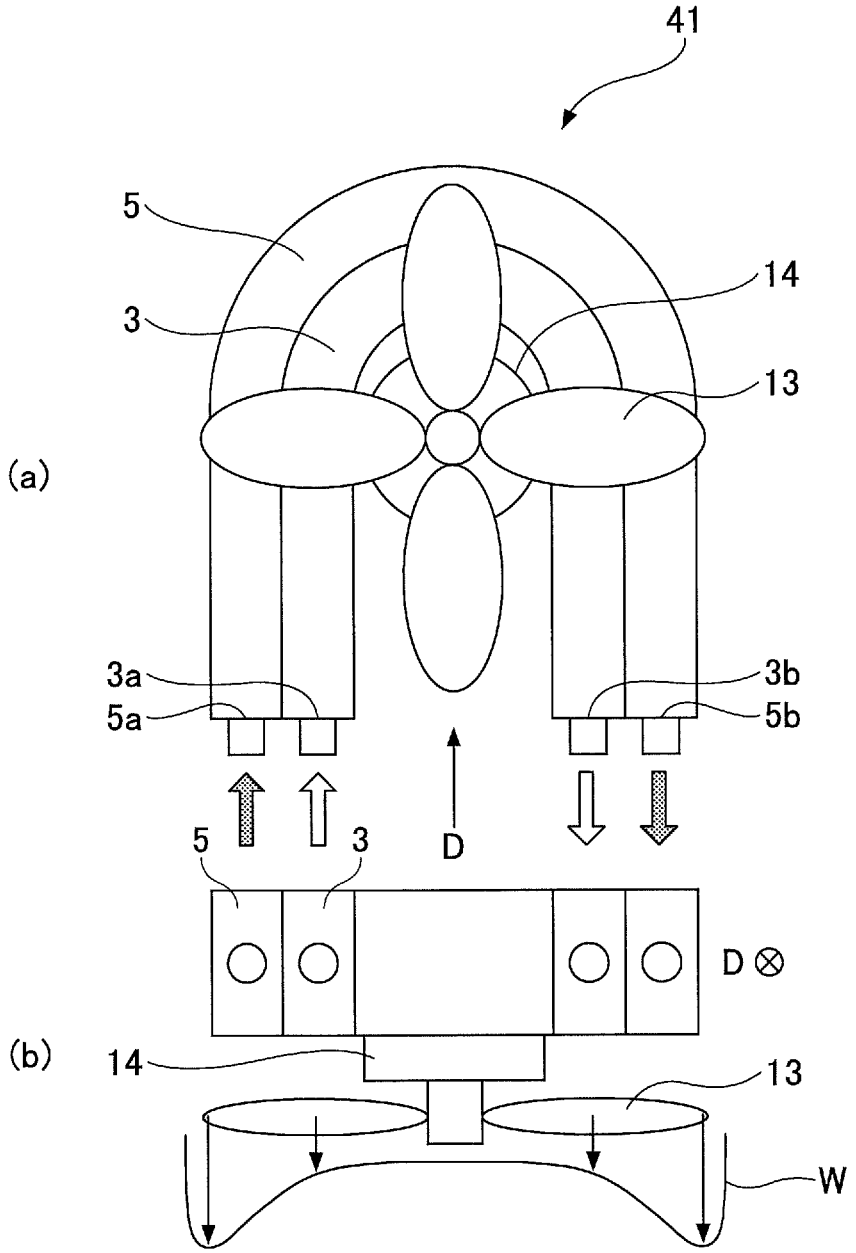
FIG. 7 is a diagram for schematically illustrating the compressor apparatus 41 according to a fourth embodiment viewed in axial and radial directions of the axial-flow fan 13.

As illustrated in FIG. 7 (*a*), according to the fourth embodiment, the oil cooler 4 and the gas cooler 5 included in a heat exchanger group nave U-shapes in a view along the rotational axis of the axial-flow fan 13. In the fourth embodiment, the oil cooler 4 and the gas cooler 5 are adjacent to each other such that a boundary between the intermediate portion of the oil cooler 3 and the intermediate portion of the gas cooler 5, which extend in the circumferential direction of the axial-flow fan 13, is at the midpoint in a radial direction or near the midpoint in a radial direction described above with reference to the air velocity distribution w, as illustrated in FIG. 7 (*b*) which is a view in a direction "D" in FIG. 7 (*a*).

In the fourth embodiment, the gas cooler 5 with higher heat exchanging amount, among the oil cooler 3 and the gas cooler 5, which are neighboring heat exchangers in a radial direction, is allocated an outward region in a radial direction of the air velocity distribution W in which the air velocity is higher such as illustrated in FIG. 7 (*b*), while the oil cooler 3 with less heat exchanging amount is allocated an inward region in a radial direction in which the air velocity is lower. Inlets 3*a* and 5*b* are disposed on the left side and outlets 3*b* and 5*b* are disposed on the right side in FIG. 7 (*a*).

Similarly, according to the compressor apparatus 41 of the fourth embodiment, with respect to the air velocity distribution W illustrated, in FIG. 7 (*b*) in which the air velocity increases linearly as the position moves outward in a radial direction, the gas cooler 5 with a higher heat exchanging amount is disposed outwardly in a radial direction, while the oil cooler 3 with less heat exchanging amount is disposed inwardly in a radial direction, thereby increasing cooling efficiency.

According to the fourth embodiment, as is the case with the third embodiment, because the heat exchangers partially extend in the circumferential direction of the axial-flow fan 13, the width (dimension in the radial direction) of the heat exchanger at the outward position in a radial direction can be made smaller.

Fifth Embodiment

A compressor apparatus 51 of a single-stage type according to the fifth embodiment is configured such that it includes a single refrigerator 17 of a GM type as described above, for example. Components themselves are basically not different from those illustrated in FIG. 1. Thus, in FIG. 8, corresponding components are given the same reference numbers and a redundant explanation is omitted as much as possible.

Figure 8:
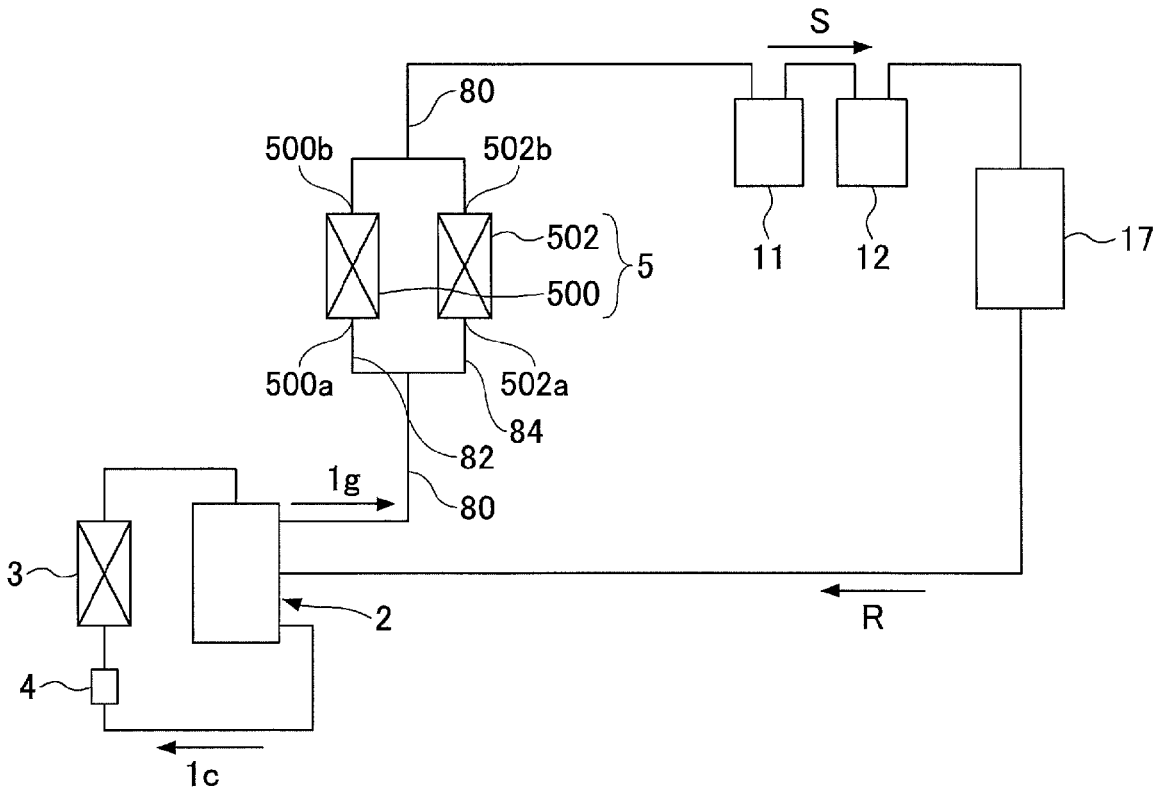
FIG. 8 is a diagram, for schematically illustrating a flow of a refrigerant (refrigerant gas) in a compressor apparatus 51 according to a fifth embodiment.

As illustrated in FIG. 8, the compressor apparatus 51 according to the fifth embodiment differs from the compressor apparatus 31 according to the third embodiment illustrated in FIG. 5 in that a gas cooler 5 is formed by two gas cooler elements (heat exchanger elements) 500 and 502. Accordingly, a fluid channel 80 for a fluid, that is flew into the gas cooler 5 is divided into two fluid channels 82 and 84 that are connected to corresponding inlets 500*a* and 502*a* of the gas cooler elements 500 and 502. Further, the fluid channels 82 and 84 are unified to a single fluid channel 80 after outlets 500*b* and 502*b* of the gas cooler elements 500 and 502.

In the fifth embodiment, it is assumed that the heat exchanging amount of the gas cooler 5 is greater than that of the oil cooler 3. This is because the flow rate of the helium gas at the gas cooler 5 is substantially greater than that at the oil cooler 3, for example. For this reason, the gas cooler 5 with a higher heat exchanging amount, among the oil cooler 3 and the gas cooler 5, which are neighboring heat exchangers in a radial direction, is allocated an outward region in a radial direction of the air velocity distribution W such as illustrated in FIG. 9 (*b*), while the oil cooler 3 with less heat exchanging amount is allocated an inward region in a radial, direction in which the air velocity is lower.

Figure 9:
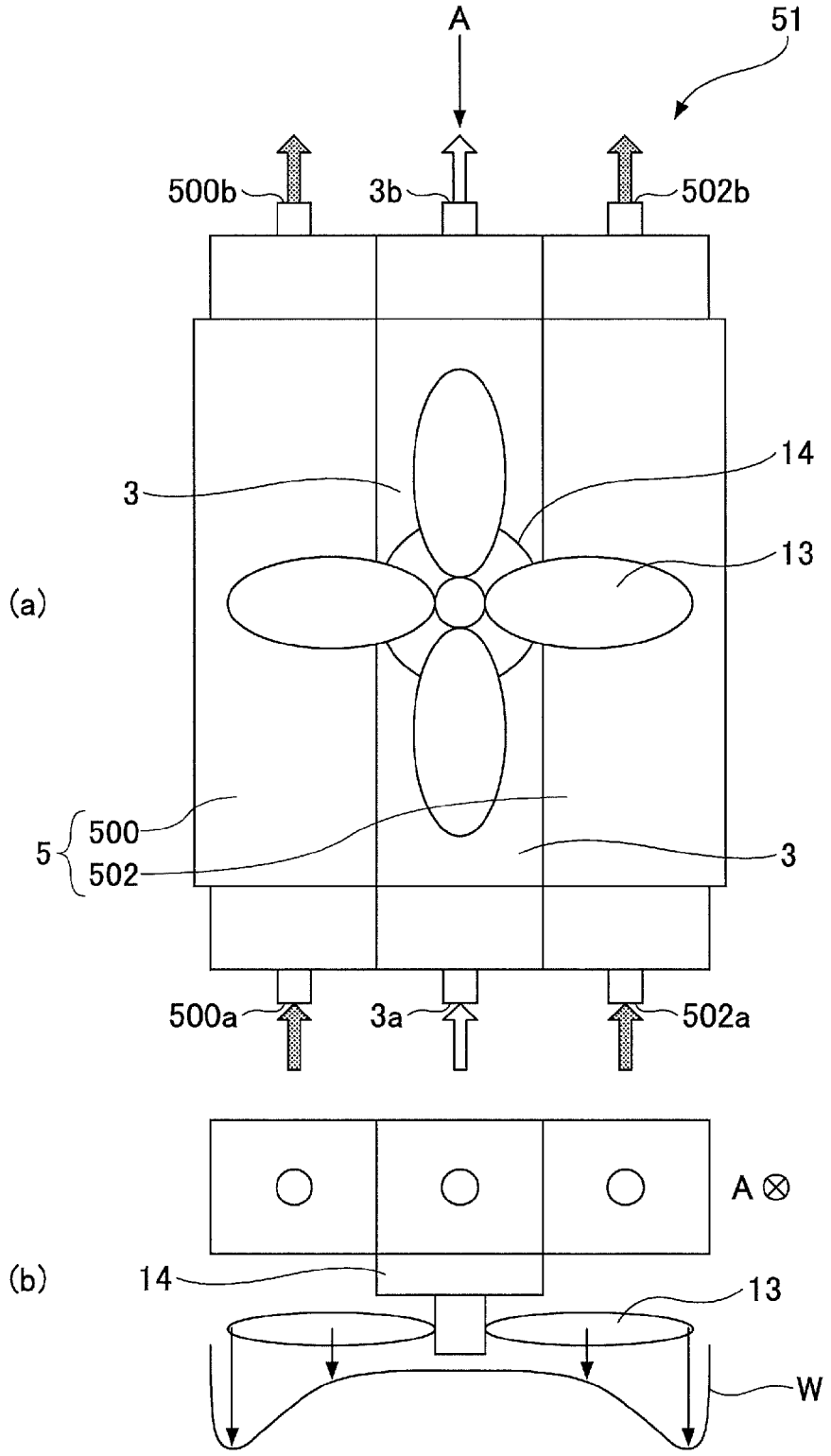
FIG. 9 is a diagram for schematically illustrating the compressor apparatus 51 according to the fifth embodiment viewed in axial and radial directions of the axial-flow fan 13.

Specifically, in FIG. 9 (*a*), the oil cooler 3 and the gas cooler 5 have rectangular parallelepiped shapes that extend in parallel in a direction (in up and down direction in the example illustrated in FIG. 9 (*a*), for example) perpendicular to a radial direction of the rotational axis of the axial-flow fan 13. The respective heat exchangers have widths corresponding to the heat exchanging amounts thereof. The widths are defined with respect to the extension direction of the heat exchangers. The heat exchangers (gas cooler elements 500 and 502 in the case of the gas cooler 55 each have inlets indicated by a numerical subscript "a" and outlets indicated by a numerical, subscript "b".

The oil cooler 3 extends at a center (immediately below the rotational axis) such that it intersects with the rotational axis of the axial-flow fan 13 in a view along the rotational axis of the axial-flow fan 13. The gas cooler elements 500 and 502 of the gas cooler 5 extend on the opposite sides of the oil cooler 3. Then, the oil cooler 3 may be disposed such that a boundary between the oil cooler 3 and the gas cooler elements 500 and 502 of the gas cooler 5 is at the midpoint in a radial direction or near the midpoint in a radial direction.

According to the compressor apparatus 51 of the fifth embodiment, it becomes possible to avoid such a situation where mechanical and electrical losses are increased due to the increased number of the cooling fans and the fan motors and thus more electric power is required. Furthermore, it becomes possible to prevent an overall reduction in a volume of air and increase cooling efficiency. Further, it becomes possible to reduce a number of parts and cost by reducing a failure rate as well as running cost.

Furthermore, according to the fifth embodiment, by dividing the gas cooler 5 into the gas cooler elements 500 and 502, the gas cooler elements 500 and 502 each can be allocated an outward region in a radial direction of the air velocity distribution W. As a result of this, more efficient cooling can be implemented, and energy-saving can be enhanced.

In the fifth embodiment, the gas cooler 5 is formed by two gas cooler elements (heat exchanger elements) 500 and 502; however, the gas cooler 5 may be divided into three or more gas cooler elements. When the gas cooler elements extends on the opposite sides of the oil cooler and the outward region in a radial direction of the air velocity distribution W can be allocated to the respective gas cooler elements, the same effects can be obtained.

The present invention is disclosed with reference to the preferred embodiments. However, it should be understood that the present invention is not limited to the above-described embodiments, and variations and modifications may be made without departing from the scope of the present invention.

For example, the embodiments described above, the fan motor 14 is disposed in the casing such that the fan motor 14 is located on the inner side with respect to the axial-flow fan 13; however, the fan motor 14 may be located on the outer side with respect to the axial-flow fan 13. Further, the direction of air flow along the rotational axis of the axial-flow fan 13 may be reversed. In other words, the axial-flow fan 13 may be of an air suction type. Further, the layout illustrated in FIG. 3 is just an example. Further, the U-shaped heat exchanger according to the fourth embodiment can be applied to the first and second embodiments.

The present application is based on Japanese Priority Application No. 2011-184991, filed on Aug. 26, 2011, the entire contents of which are hereby incorporated by reference.

This disclosure is related to a compressor apparatus that is applied to a cryogenic refrigerator as well as a refrigerator apparatus that includes a compressor apparatus and a cryogenic refrigerator. According to the embodiments, the cooling efficiency of the compressor apparatus is increased due to the design ideas of the arrangement of the heat exchangers, which does not lead to the increase in the cost. Thus, the embodiments are suited for various facilities in which the compressor apparatus or the refrigerator apparatus that includes a compressor apparatus is applied. Further, according to the embodiments, the installation density of the motors and the heat exchangers in a compressor apparatus can be increased.

What is claimed is:

1. A compressor apparatus for supplying a compressed refrigerant to a cryogenic refrigerator, comprising:

a heat exchanger group that includes a first heat exchanger and a second heat exchanger whose heat exchanging amount is greater than the first heat exchanger; and an axial-flow fan that cools the heat exchanger group, wherein the first heat exchanger and the second heat exchanger are disposed side by side in a radial direction perpendicular to a rotational axis of the axial-flow fan, and the first heat exchanger is disposed closer to the rotational axis of the axial-flow fan in the radial direction with respect to the second heat exchanger, and the heat exchanger group extends straight from an inlet side to an outlet side, and the heat exchanger group is overlapped with the axial-flow fan when viewed in the rotational axis of the axial-flow fan, wherein compression of the refrigerant is performed in two stages, the heat exchanger group includes a higher stage side heat exchanger disposed on a higher stage side of the two stages, and a lower stage side heat exchanger disposed on a lower stage side, the lower stage side heat exchanger being closer to the rotational axis with respect to the higher stage side heat exchanger.

2. The compressor apparatus of claim 1, wherein the heat exchanger group extends in the direction perpendicular to the rotational axis.

3. The compressor apparatus of claim 1, wherein the heat exchanger group includes a plurality of gas heat exchangers and a plurality of fluid heat exchangers such that the gas heat exchangers are disposed on one side of the rotational axis and the fluid heat exchangers on another side of the rotational axis.

4. A refrigerator apparatus that includes the compressor apparatus of claim 1 and the cryogenic refrigerator.

* * * * *